US006691934B2

(12) United States Patent
Egler et al.

(10) Patent No.: US 6,691,934 B2
(45) Date of Patent: Feb. 17, 2004

(54) FUEL INJECTION VALVE FOR INTERNAL COMBUSTION ENGINES

(75) Inventors: Walter Egler, Gerlingen (DE); Peter Boehland, Marbach (DE); Sebastian Kanne, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/312,387

(22) PCT Filed: Mar. 22, 2002

(86) PCT No.: PCT/DE02/01038

§ 371 (c)(1),
(2), (4) Date: Mar. 24, 2003

(87) PCT Pub. No.: WO02/090755

PCT Pub. Date: Nov. 14, 2002

(65) Prior Publication Data

US 2003/0168528 A1 Sep. 11, 2003

(30) Foreign Application Priority Data

May 5, 2001 (DE) ..... 101 21 892

(51) Int. Cl.[7] ..... F02M 63/00

(52) U.S. Cl. ..... 239/533.2; 239/88; 239/89; 239/93; 239/96; 239/585.1; 239/585.2

(58) Field of Search ..... 239/88, 89, 90, 239/91, 92, 93, 94, 95, 96, 585.1, 585.2, 585.3, 585.4, 585.5, 533.2

(56) References Cited

U.S. PATENT DOCUMENTS

| | | | | | |
|---|---|---|---|---|---|
| 4,161,161 | A | * | 7/1979 | Bastenhof | 239/533.3 |
| 5,697,554 | A | * | 12/1997 | Auwaerter et al. | 239/88 |
| 5,901,941 | A | * | 5/1999 | Ricco | 239/585.3 |
| 6,367,709 | B2 | * | 4/2002 | Heinz et al. | 239/96 |
| 6,568,606 | B2 | * | 5/2003 | Boecking | 239/533.2 |

FOREIGN PATENT DOCUMENTS

| | | | | |
|---|---|---|---|---|
| DE | 888038 | * | 8/1953 | |
| DE | 19727896 A1 | * | 1/1999 | F02M/41/16 |
| DE | 19940293 A1 | * | 3/2001 | F02M/47/02 |

* cited by examiner

*Primary Examiner*—Robin O. Evans
(74) *Attorney, Agent, or Firm*—Ronald E. Greigg

(57) ABSTRACT

A fuel injection valve includes a housing in which a piston-like valve member is disposed longitudinally displaceably in a bore to cause at least one injection opening to communicate with a pressure chamber embodied in the housing. An inlet conduit discharges into the pressure chamber to fill the pressure chamber with fuel at high pressure. A fuel-filled control chamber in the housing at least indirectly exerts a force acting in the closing direction on the valve member. The control chamber communicates with the inlet conduit and can be made to communicate via a control valve with a leak fuel chamber. A damping chamber communicates with the inlet conduit via a throttle.

6 Claims, 2 Drawing Sheets

FUEL INJECTION VALVE FOR INTERNAL COMBUSTION ENGINES

CROSS-REFERENCE TO RELATED APPLICATIONS

This application is a 35 USC 371 application of PCT/DE 02/01038 filed on Mar. 22, 2002.

BACKGROUND OF THE INVENTION

1. Field of the Invention

The invention is directed to an improved fuel injection valve for internal combustion engines.

2. Description of the Prior Art

Fuel injection valves are known from the prior art in various versions. For instance, in German Patent Disclosure DE 196 50 865 A1, a fuel injection valve is described that communicates constantly with a common rail in which fuel at high pressure is furnished. The fuel injection valve has a housing in which a valve member is disposed longitudinally displaceably in a bore; by its longitudinal motion, the valve member controls the opening of at least one injection opening, through which fuel from a pressure chamber surrounding the valve member is injected into the combustion chamber of the engine. The pressure chamber here communicates constantly with the common rail, via an inlet conduit extending in the housing of the fuel injection valve, and the fuel in the pressure chamber acts in the opening direction on a pressure face embodied on the valve member. A control chamber is also embodied in the housing; it can be filled with fuel and indirectly exerts a hydraulic force, acting in the closing direction, on the valve member. The valve member thus remains in its closed state, given a suitable pressure in the control chamber. If by means of a control valve the pressure in the control chamber is lowered because the control chamber is made to communicate with a leak fuel chamber, then the closing force on the valve member decreases, and the valve member is moved in the opening direction by the hydraulic pressure in the pressure chamber and uncovers the at least one injection opening. If the injection is to be terminated, the control valve is actuated, and fuel flows out of the inlet conduit into the control chamber, so that a high fuel pressure builds up there once again. As a result, the valve member is moved in the closing direction and discontinues the fuel injection through the injection openings.

Because of these very fast closing events, which elapse within only a few milliseconds, pressure fluctuations in the high-pressure region of the fuel injection valve occur both upon the motion of the valve member and upon switching of the control valve; on the one hand, they cause severe mechanical stresses on the housing, and on the other, they have the effect that the subsequent injection begins at a state that is not precisely defined, making accurate metering and an exact determination of the instant of injection impossible. Especially in the region where the control chamber and the inlet conduit communicate, such pressure fluctuations are problematic, because they make precise pressure control in the control chamber and hence precise control of the valve member difficult. This plays a particularly major role in injection events that are broken down into a preinjection, main injection, and/or postinjection, since modern injection systems react quite sensitively to fluctuations in the injection quantity.

SUMMARY OF THE INVENTION

The fuel injection valve of the invention has the advantage over the prior art that precisely defined injection events in rapid succession are made possible. Pressure fluctuations that occur in the region of the inlet conduit are rapidly damped, so that very quickly after the control valve has been actuated, a static pressure level is again reached both in the inlet conduit and in the control chamber. Pressure fluctuations in the inlet conduit, which can propagate over the entire fuel column within the inlet conduit, from the pressure chamber back into the high-pressure fuel source, fade quickly because of the damping chamber of the invention.

The inlet conduit communicates with a damping chamber, which is embodied as a hollow space in the housing of the fuel injection valve. Between the inlet conduit and the damping chamber there is a throttle, so that the fuel flowing out of the inlet conduit into the damping chamber, or in the opposite direction, must overcome the resistance of the throttle, and consequently the flowing motion is damped. If pressure changes occur in the inlet conduit, of the kind caused for instance by the opening or closing of the control valve or the valve member, then a higher or lower fuel pressure than in the damping chamber prevails in the inlet conduit. Because of this pressure gradient, fuel will flow through the throttle either from the inlet conduit into the damping chamber or from the damping chamber into the inlet conduit and thus bring about a pressure equalization between the damping chamber and the inlet conduit. Since the fuel flowing back and forth then must pass through the throttle, these flowing motions are damped by friction losses at the throttle, so that very quickly, these pressure fluctuations fade and a static pressure level in the inlet conduit is reached.

In an advantageous feature of the subject of the invention, the damping chamber is embodied as a blind bore in the housing of the fuel injection valve. The throttle is embodied near the inlet conduit, in the communication between the inlet conduit and the damping chamber, in order to achieve an optimal damping effect. Because the damping chamber is embodied as a blind bore, the damping chamber in the housing is simple and economical to produce.

In another advantageous feature, more than one throttle is disposed in the housing, forming a communication from the damping chamber to the inlet conduit. As a result, the damping action of the throttles can be boosted, and by way of various throttles, better adaptation to the requirements of the fuel injection valve can be made.

BRIEF DESCRIPTION OF THE DRAWINGS

Further advantages and advantageous features of the subject of the invention can be learned from the description contained herein below, taken in conjunction with the drawings, in which.

DESCRIPTION OF THE PREFERRED EMBODIMENTS

Figure 1:
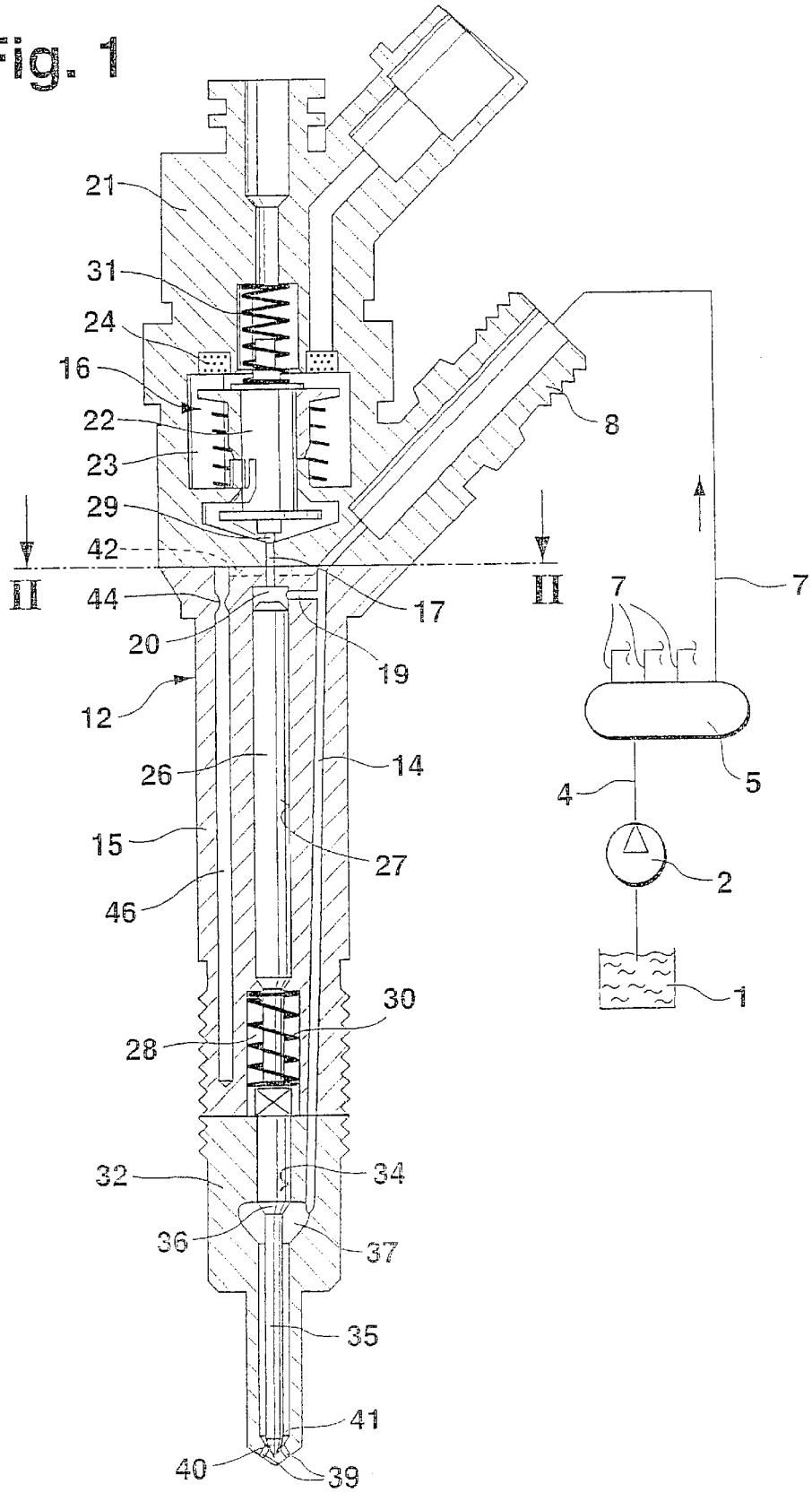
FIG. 1 shows a fuel injection valve in longitudinal section, together with the high-pressure fuel supply system that is shown schematically.

In FIG. 1, a longitudinal section through a fuel injection valve of the invention is shown, along with the schematically shown high-pressure fuel supply system. The fuel injection valve has a housing 12, which includes a valve holding body 15, a valve body 32, and a control valve body 21. Toward the combustion chamber, the valve body 32 is disposed in the engine, and the combustion chamber adjoins it, on the side remote from the valve holding body 15. The valve body 32 and the valve holding body 15 are braced against one another by means of a lock nut, not shown in the drawing for the sake of simplicity. The control valve body 21 is disposed on the side of the valve holding body 15 remote from the combustion chamber, and both bodies rest on the end faces facing one another. The control valve body 21 is braced against the valve holding body 15 by a device not shown in the drawing, so that a sealing communication between the fuel conduits extending in both bodies is possible.

A bore 34 is embodied in the valve body 32, and a pistonlike valve member 35 is disposed longitudinally displaceably in this bore. The valve member 35 is guided sealingly in a portion of the bore 34 remote from the combustion chamber, and it tapers toward the combustion chamber, forming a pressure shoulder 36. At the level of the pressure shoulder 36, a radial widening of the bore 34 forms a pressure chamber 37 in the valve body 32 that continues, in the form of an annular conduit surrounding the valve member 35, as far as the end toward the combustion chamber of the bore 34. With its end toward the combustion chamber, the valve member 35 controls the opening of at least one injection opening 39, with which the pressure chamber 37 communicates with the combustion chamber of the engine. To that end, a valve sealing face 40 is embodied on the end of the valve member 35 toward the combustion chamber; it cooperates with a valve seat 41 embodied on the end toward the combustion chamber of the bore 34. The pressure chamber 37 communicates, via an inlet conduit 14 embodied in the housing 12, with a high-pressure connection 8 embodied on the control valve body 21. The high-pressure connection 8 communicates via a high-pressure line 7 with a common rail 5, in which fuel is present at a predetermined, high pressure; the fuel is delivered to the common rail 5 from a fuel tank 1 via a high-pressure pump 2 and a fuel line 4.

On the side remote from the combustion chamber of the valve member 35, a spring chamber 28 is embodied in the valve holding body 15, and a helical compression spring 30 is disposed in it. The helical compression spring 30 is prestressed for compression and with its end toward the valve member 35 it urges the valve member 35 in the closing direction. Coaxially to the bore 34 and on the side of the spring chamber 28 remote from the combustion chamber, a piston bore 27 is embodied in the valve holding body 15; it discharges into the spring chamber 28 and a piston rod 26 is disposed in it that with its end toward the combustion chamber rests on the valve member 35, while with its face end remote from the combustion chamber the piston rod defines a control chamber 20. The control chamber communicates here with the inlet conduit 14 via a conduit embodied as an inlet throttle 19 and with a leak fuel chamber 23 embodied in the valve holding body 15 via an outlet throttle 17; the leak fuel chamber communicates with a leak fuel system, not shown in the drawing, and as a result constantly has a low pressure. A magnet armature 22 is disposed in the leak fuel chamber 23; it is urged in the direction of the control chamber 20 by a closing spring 31, and a sealing ball 29 is secured to it that closes the outlet throttle 17. An electromagnet 24 is also disposed in the leak fuel chamber 23; when it is supplied with suitable current, it exerts an attracting force, counter to the force of the closing spring 31, on the magnet armature 22 and moves it away from the control chamber 20, as a result of which the control chamber 20 communicates with the leak fuel chamber 23. If the electromagnet 24 is rendered currentless, then the magnet armature 22 moves back in the direction of the control chamber 20 by the force of the closing spring 31 and, with its sealing ball 29, closes the outlet throttle 17. The magnet armature 22 together with the outlet throttle 17 thus forms a control valve 16.

Figure 2:
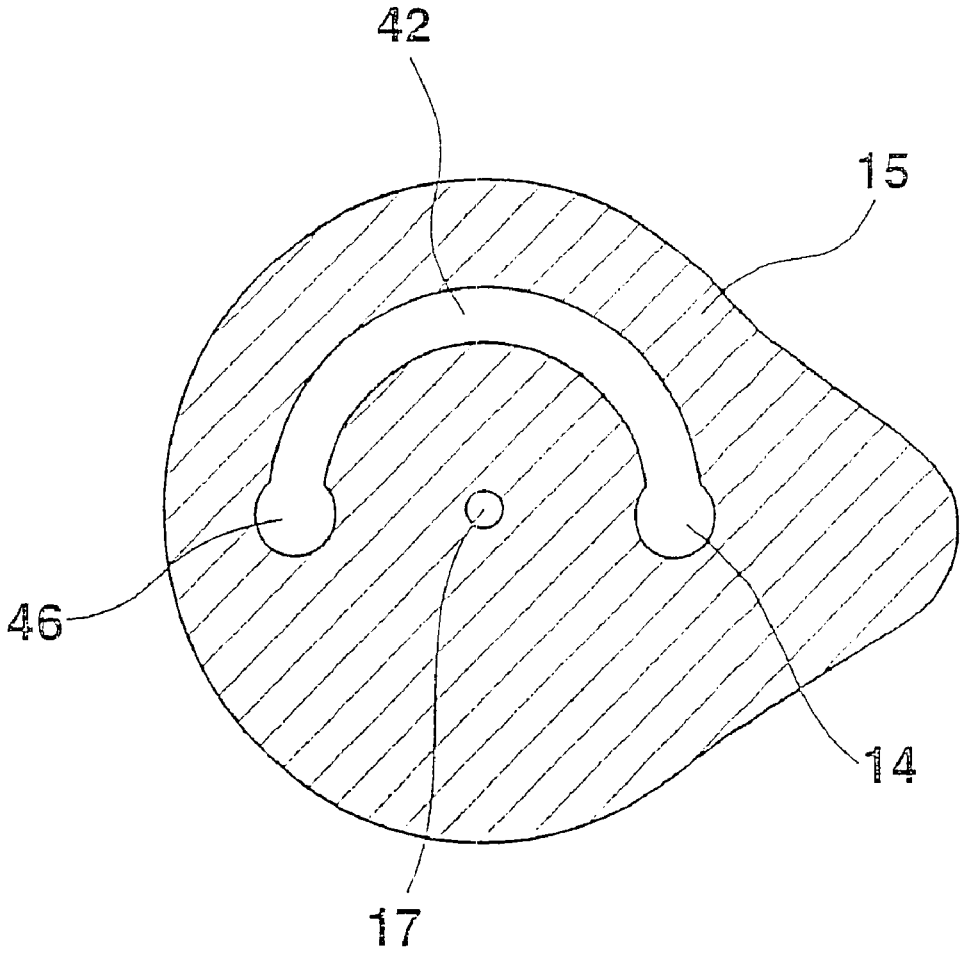
FIG. 2 is a cross section through the fuel injection valve, taken along the line II—II of FIG. 1.

A damping chamber 46 is embodied as a blind bore in the valve holding body 15, and its open end is disposed on the end face of the valve holding body 15 oriented toward the control valve body 21. The blind bore that forms the damping chamber 46 extends parallel to the piston bore 27 and communicates with the inlet conduit 14 via a groove that extends on the end face of the valve holding body 15 and forms a curved connection 42. In FIG. 2, a cross section taken along the line II—II of FIG. 1 is shown, so that the course of the connection 42 becomes clear. Near the end face of the valve holding body 15 toward the control valve body 21, the throttle 44 is provided, preferably by means of a cross-sectional reduction of the blind bore that forms the damping chamber 46. If a pressure difference prevails between the inlet conduit 14 and the damping chamber 46, then fuel can flow from one chamber to the other via the connection 42 and the throttle 44 and thus bring about a pressure equalization.

The mode of operation of the fuel injection valve is as follows: Because of the communication of the pressure chamber 37 with the common rail 5 via the inlet conduit 14 and the high-pressure line 7, a high fuel pressure of the kind also kept in reserve in the common rail 5 always prevails in the pressure chamber 37. If an injection is to occur, the electromagnet 24 is actuated, and the magnet armature 22 uncovers the outlet throttle 17 in the manner described above. As a result, the fuel pressure in the control chamber 20 drops, and the hydraulic force on the face end, remote from the combustion chamber, of the piston rod 26 is reduced, so that the hydraulic force on the pressure shoulder 36 predominates, and the valve member 35 is moved in the opening direction, as a result of which the injection openings 39 are uncovered. To terminate the injection, the current supply to the electromagnet 24 is changed accordingly, and with the sealing ball 29 the magnet armature 22, moved by the force of the closing spring 31, again closes the outlet throttle 17. As a result of the replenishing fuel flowing through the inlet throttle 19, the high fuel pressure that also prevails in the inlet conduit 14 builds up again in the control chamber 20, and so the hydraulic force on the piston rod 26 becomes greater than the hydraulic force on the pressure shoulder 36, and the valve member 35 returns to its closing position. As a result of the closing process of the valve member 35 and magnet armature 22 and the rapid closure of the outlet throttle 17, pressure fluctuations occur in the control chamber 20 and have an effect as far as the inside of the inlet conduit 14. Moreover, because of the closing process, the fuel that flows in the pressure chamber 37 in the direction of the injection openings 39 during the injection is abruptly decelerated, so that the energy of motion of the fuel is converted into compression work. This creates a pressure wave, which propagates in the pressure chamber 37 and in the inlet conduit 14. The pressure changes thus caused in the inlet conduit 14 lead to a pressure difference between the inlet conduit 14 and the damping chamber 46, where at least approximately the pressure still prevails that was present in the inlet conduit 14 as well before the onset of the injection. As a result of this pressure difference, some fuel flows out of the inlet conduit 14 through the connection 42 and the throttle 44 into the damping chamber 46, and from there, in accordance with the pressure difference between the damping chamber 46 and the inlet conduit 14, back again into the inlet conduit 14. On passing through the throttle 44, friction work must necessarily be performed, which rapidly damps these pressure fluctuations, so that already after only a short time a static pressure level is again reached in the inlet conduit 14. For the next injection, a defined pressure state thus exists in the inlet conduit 14 and hence also in the control chamber 20, which makes a correspondingly accurate and precise control of the pressure in the control chamber 20 possible.

As an alternative to the exemplary embodiment shown in FIG. 1, it can also be provided that the damping chamber 46 be embodied not as a blind bore but rather as a hollow space in the housing of the fuel injection valve that can assume virtually any arbitrary shape. Thus the three-dimensional possibilities of the fuel injection valve can be utilized optimally without having to make structural changes to existing functional components. Moreover, it can be provided that more than one throttle 44 be disposed in the communication between the inlet conduit and the damping chamber 46. As a result, an optimal damping performance of the throttle 44 can be achieved.

The foregoing relates to preferred exemplary embodiments of the invention, it being understood that other variants and embodiments thereof are possible within the spirit and scope of the invention, the latter being defined by the appended

We claim:

1. A fuel injection valve for internal combustion engines, comprising a housing (12), in which a pistonlike valve member (35) is disposed longitudinally displaceably in a bore (34) and by a longitudinal motion in an opening direction, with its end toward the combustion chamber, causes at least one injection opening (39) to communicate with a pressure chamber (37) embodied in the housing (12), an inlet conduit (14) that is embodied in the housing (12) and discharges into the pressure chamber (37) and by way of which conduit the pressure chamber (37) can be filled with fuel at high pressure, a control chamber (20), embodied in the housing (12) and filled with fuel, wherein the pressure in the control chamber (20) at least indirectly exerts a force acting in the closing direction on the valve member (35), the control chamber (20) communicating with the inlet conduit (14), a control valve (16), disposed in the housing (12), by way of which valve the control chamber (20) can be made to communicate with a leak fuel chamber (23) in which a markedly lower pressure prevails than in the inlet conduit (14), and a damping chamber (46) in the housing (12) communicating with the inlet conduit (14) via at least one throttle (44).

2. The fuel injection valve of claim 1, wherein the communication of the control chamber (20) with the inlet conduit (14) is a conduit (19) embodied in the housing of the fuel injection valve.

3. The fuel injection valve of claim 2, wherein the damping chamber (46) communicates with the inlet conduit (14) at least approximately at the point where the conduit (19) arriving from the control chamber (20) also discharges into the inlet conduit (14).

4. The fuel injection valve of claim 1, wherein the damping chamber (46) comprises a blind bore embodied in the housing (12).

5. The fuel injection valve of claim 1, wherein the inlet conduit (14) communicates with the damping chamber (46) via more than one throttle (44).

6. The fuel injection valve of claim 1, wherein the pressure chamber (37) communicates constantly with a common rail (5), and a predetermined, high fuel pressure is always maintained in the common rail (5).

* * * * *